US010441091B2

(12) United States Patent
Salazar et al.

(10) Patent No.: US 10,441,091 B2
(45) Date of Patent: Oct. 15, 2019

(54) ERGONOMIC OUTFACING CARRIER

(71) Applicant: Blue Box Toy Factory Limited, Kowloon (HK)

(72) Inventors: Maureen O'Connor Salazar, Chicago, IL (US); Stacy Castro, Verona, WI (US); Leslie Roeder, New York, NY (US)

(73) Assignee: Blue Box Toy Factory Limited, Kowloon (HK)

( * ) Notice: Subject to any disclaimer, the term of this patent is extended or adjusted under 35 U.S.C. 154(b) by 0 days.

(21) Appl. No.: 16/113,351

(22) Filed: Aug. 27, 2018

(65) Prior Publication Data

US 2019/0075937 A1 Mar. 14, 2019

Related U.S. Application Data

(60) Provisional application No. 62/556,927, filed on Sep. 11, 2017.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/158–160
See application file for complete search history.

(56) References Cited

U.S. PATENT DOCUMENTS

| | | | | |
|---|---|---|---|---|
| 4,234,229 | A | 11/1980 | Arnold | |
| 4,402,440 | A | 9/1983 | Purtzer et al. | |
| 4,434,920 | A | 3/1984 | Moore | |
| 4,469,259 | A | 9/1984 | Krich et al. | |
| D276,478 | S | 11/1984 | Fallon | |
| 4,492,326 | A | 1/1985 | Storm | |
| 4,986,458 | A | 1/1991 | Linday | |
| 5,361,952 | A | 11/1994 | Gold | |
| 5,522,528 | A | 6/1996 | Petricola | |
| 5,570,823 | A | 11/1996 | Lindy | |
| 5,673,828 | A | 10/1997 | Raedel et al. | |
| 5,813,580 | A | 9/1998 | Fair | |
| 6,318,608 | B1 | 11/2001 | Fowler et al. | |
| 6,415,969 | B1 | 7/2002 | Higuchi | |
| 7,252,214 | B2 | 8/2007 | Krogh | |
| 7,284,503 | B2 | 10/2007 | Elmberg | |
| 7,766,199 | B1 * | 8/2010 | Caperon | A47D 13/025 224/160 |
| 7,886,946 | B2 | 2/2011 | Gray | |
| 8,028,871 | B2 | 10/2011 | Gray | |
| 8,172,116 | B1 | 5/2012 | Lehan et al. | |
| 8,365,325 | B2 | 2/2013 | Schneider | |
| 8,424,732 | B1 | 4/2013 | Lehan et al. | |
| 8,453,894 | B2 | 6/2013 | Jung et al. | |
| 8,590,757 | B2 | 11/2013 | Frost | |
| 8,701,949 | B1 | 4/2014 | Lehan et al. | |

(Continued)

*Primary Examiner* — Adam J Waggenspack
(74) *Attorney, Agent, or Firm* — Stetina Brunda Garred and Brucker; Mark B. Garred

(57) ABSTRACT

An adjustable infant carrier which is outfitted with various modalities, including a selectively expandable and retractable seat portion and a selectively deployable sling seat, as allows for varying degrees of adjustability to the effective width of and support level provided by the seat portion of the carrier alone or in combination with the seat sling thereof.

20 Claims, 6 Drawing Sheets

(56) References Cited

U.S. PATENT DOCUMENTS

| | | | | |
|---|---|---|---|---|
| 8,752,739 | B2 * | 6/2014 | Bergkvist | A47D 13/025 224/158 |
| 9,022,260 | B2 | 5/2015 | Frost | |
| 9,185,993 | B2 | 11/2015 | Telford et al. | |
| 9,357,852 | B2 * | 6/2016 | Salazar | A47D 13/025 |
| 9,713,391 | B2 * | 7/2017 | Telford | A47D 13/025 |
| 2007/0029356 | A1 | 2/2007 | Moriguchi et al. | |
| 2008/0283559 | A1 | 11/2008 | Parness et al. | |
| 2009/0101683 | A1 | 4/2009 | Gilboa et al. | |
| 2010/0147910 | A1 | 6/2010 | Schachtner | |
| 2010/0308088 | A1 * | 12/2010 | Lindblom | A47D 13/025 224/160 |
| 2011/0042429 | A1 | 2/2011 | Frost | |
| 2011/0101051 | A1 | 5/2011 | Parness et al. | |
| 2011/0290831 | A1 | 12/2011 | Wang | |
| 2012/0199619 | A1 | 8/2012 | Zack | |
| 2013/0023810 | A1 | 1/2013 | Schmid et al. | |
| 2013/0284783 | A1 | 10/2013 | Burpee | |
| 2014/0263491 | A1 | 9/2014 | Telford et al. | |
| 2014/0284361 | A1 | 9/2014 | Wang | |

* cited by examiner

ERGONOMIC OUTFACING CARRIER

CROSS-REFERENCE TO RELATED APPLICATIONS

The present application claims priority to U.S. Provisional Patent Application Ser. No. 62/556,927 entitled Ergonomic Outfacing Carrier filed Sep. 11, 2017, the disclosure of which is incorporated herein by reference.

STATEMENT RE: FEDERALLY SPONSORED RESEARCH/DEVELOPMENT

Not Applicable

BACKGROUND

1. Technical Field

The present disclosure generally relates to an infant carrier and, more particularly, to an infant carrier which is outfitted with various modalities, including a selectively expandable and retractable seat portion and a selectively deployable sling seat, as allows for varying degrees of adjustability to the effective width of and support level provided by the seat portion of the carrier alone or in combination with the seat sling thereof.

2. Description of the Related Art

It is common practice for parents and other caregivers to carry infants and toddlers, and there is a variety of well-known infant carrier products in the prior art which are configured to be worn by an adult for on-the-body carrying of the infant or toddler. These products include slings, wraps, pouches, and backpack-like devices outfitted with shoulder strap devices in varying configurations and arrangements. Shoulder-supported infant carriers are particularly growing in popularity for supporting or transporting an infant or young child. A common attribute of these carriers is that they typically offer "hands free" operation, and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in places such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant, and are typically used to carry the infant of the front or chest of the wearer.

Although soft-sided carriers have become a popular means for transporting an infant, most soft-sided carriers suffer from one or more drawbacks. For instance, one common drawback associated with conventional soft-sided carriers is that the seat portion of the carrier is of a fixed size. Therefore, as the infant grows, the seat portion of the carrier may become too small, or when the infant is young, the seat portion of the carrier may be configured to support a larger infant, and thus, may be too big. Furthermore, the fixed nature of the seat portion on many conventional infant carriers may limit the adaptability achievable by the infant carriers, i.e., the infant carrier may not be easily or comfortably adaptable in both front carry and rear carry configurations. The infant carrier described below addresses this drawback through its inclusion of various modalities, including a selectively expandable seat portion and a selectively deployable sling seat, as allows for varying degrees of adjustability to the effective width of and support level provided by the seat portion of the carrier alone or in combination with the seat sling, and also allows for use of the carrier in several front carry configurations in addition to a rear carry configuration. These and other aspects of the present infant carrier will be discussed in more detail below.

BRIEF SUMMARY

Various aspects of the present disclosure are directed toward an adjustable infant carrier which is outfitted with various modalities, including a selectively expandable seat portion and a selectively deployable sling seat, as allows for varying degrees of adjustability to the effective width of and support level provided by the seat portion of the carrier alone or in combination with the seat sling to accommodate children of differing size, as well as different support positions/configurations.

According to one embodiment of the present disclosure, the adjustable infant carrier comprises a main body panel defining a seat portion, a head portion, a central portion between the seat and head portions. The carrier further comprises a bib panel and an elongate waist belt which is extensible about the waist of a wearer. The lower ends of both the main body and bib panels are attached to the waist belt such that the main body and bib panels collectively define a child carrying area of the carrier. The carrier further comprises a pair of shoulder straps which are extensible over the wearer's shoulders, and each have opposed first and second end portions coupled to respective, prescribed regions of the main body and bib panels. While a central section of the lower end of the seat portion is permanently secured to the waist belt, the lower regions of opposed side sections of the seat portion are slidably secured to the waist belt via respective ones of an identically configured pair of slider buckles which are each operatively coupled to a complementary slider tube attached to and extending along a portion of the waist belt. Upper regions of the opposed side sections of the seat portion, and the central portion, are also each outfitted with adjustment arrangements which allow the side sections to either be releasably secured to the central portion of the main body panel or, when released therefrom, folded into overlapping relation to a central section of the seat portion and maintained in releasable engagement thereto. In addition, lower regions of the opposed side sections of the seat portion, and the waist belt, are each outfitted with securing arrangements which allow the side sections to optionally be maintained in releasable engagement to the waist belt.

Through the use of the slider buckles/slider tube alone or in combination with the adjustment and securing arrangements, the side sections of the seat portion can optionally be manipulated into any one of three (3) different configurations or states. These are: 1) a fully expanded configuration wherein both the upper and lower regions of each of the side sections of the seat portion are fully extended from the central section thereof, the lower regions of the side sections being maintained in this state via both the slider buckles which are frictionally engaged to and maintained in locations on the slider tube which correspond to the expanded positions of the lower regions and the releasable attachment of the lower regions to the waist belt via the securing arrangements, with the upper regions of the side sections being maintained in this state via the releasable attachment thereof to the central portion via the adjustment arrangements; 2) a partially expanded configuration wherein the upper region of each of the side sections of the seat portion is fully extended from the central section thereof, while the lower regions of the side sections are each retracted or narrowed inwardly toward the central section of the seat portion, the lower regions being maintained in this state via the slider buckles which are frictionally engaged to and maintained in locations on the slider tube which correspond to the retracted positions of the lower regions, with the upper regions of the side sections being maintained in this state via the releasable attachment thereof to the central portion via the adjustment arrangements; and 3) a fully retracted configuration wherein the upper region of each of the side sections of the seat portion is folded into overlapping relation to the central section of the seat portion and releasably secured thereto, while the lower regions of the side sections are each retracted or narrowed inwardly toward the central section of the seat portion, the lower regions being maintained in this state via the slider buckles which are frictionally engaged to and maintained in locations on the slider tube which correspond to the retracted positions of the lower regions.

The carrier further comprises a seat sling which is coupled to the waist belt, and selectively movable between stowed and deployed configurations or states relative thereto. In the stowed state, the seat sling is maintained in overlapping relation to an exterior surface portion of the waist belt through the use of an identically configured pair of spring latches which protrude from respective ones of the opposed ends of the seat sling. The seat sling is maintained in the stowed configuration when the side sections are in either the fully expanded or partially expanded configurations. In the deployed state, the spring latches are detached from the waist belt, and alternatively used to releasably attach the seat sling to the central portion of the main body panel. The seat sling is manipulated into the deployed configuration only when the side sections are in the fully retracted configuration.

In the infant carrier, the head portion of the main body panel is foldable relative to the remainder thereof from an extended state to a folded state. When in the folded state, the head portion at least partially overlaps the outer surface of the central portion.

The infant carrier further comprises a pair of leg loops which are attached to respective ones of the opposed side edges of the bib panel in spaced relation to the top edge of the waist belt. The leg loops are selectively, releasably attachable to those portions of respective ones of the corresponding pair of adjustments arrangements which are integrated into the upper regions of respective ones of the side sections of the seat portion included in the main body panel. The leg loops, when attached to the corresponding adjustment arrangements, create prescribed attachment points between the main body and bib panels, and facilitate the formation of a spaced pair of comparatively smaller leg openings between the leg loops and the waist belt.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
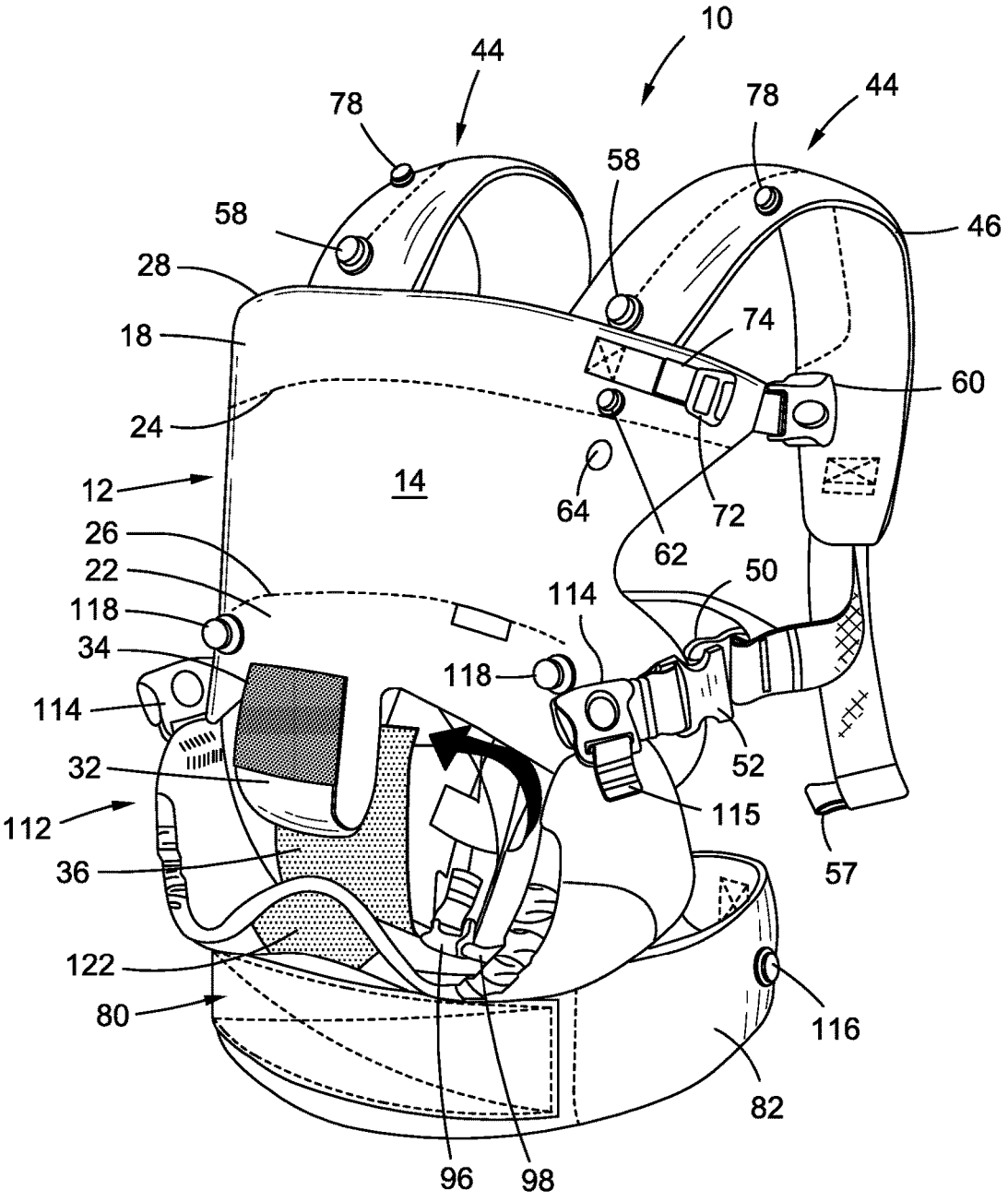
FIG. 1 is a front perspective view of an adjustable infant carrier constructed in accordance with the present disclosure, the seat portion of the carrier being depicted in a fully retracted or narrowed configuration, with the seat sling of the carrier being depicted in a partially deployed state.

Referring now to the drawings, wherein the showings are for purposes of illustrating one embodiment of the present disclosure only, and not for purposes of limiting the same, there is depicted an adjustable infant carrier 10 constructed in accordance with the present disclosure. The infant carrier 10 is specifically configured and adapted to provide enhanced adjustability and ease-of-use relative to conventional infant carriers. More specifically, the infant carrier 10 is outfitted with the structural features described with particularity below which are adapted to allow for adjustability to the effective width of the seat portion of the carrier 10 so as to accommodate children of differing size, as well as different support positions/configurations. The infant carrier 10 is additionally configured to be worn in both front and back carry configurations.

Figure 2:
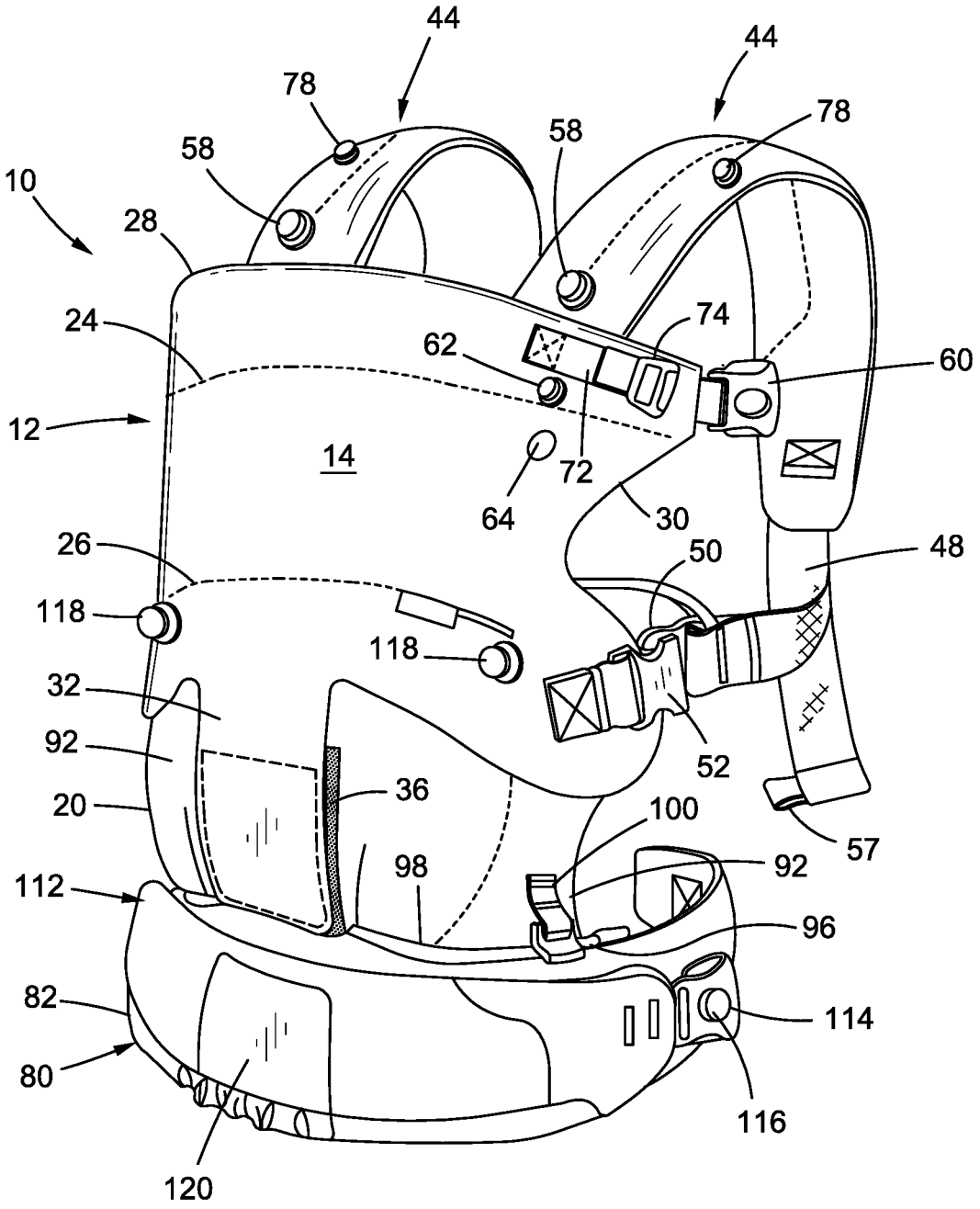
FIG. 2 is a front perspective view of the infant carrier similar to FIG. 1, but depicting the seat portion of the carrier in a fully expanded or extended configuration, with the seat sling of the carrier being depicted in a stowed state in engagement with the waist belt of the carrier.
Figure 3:
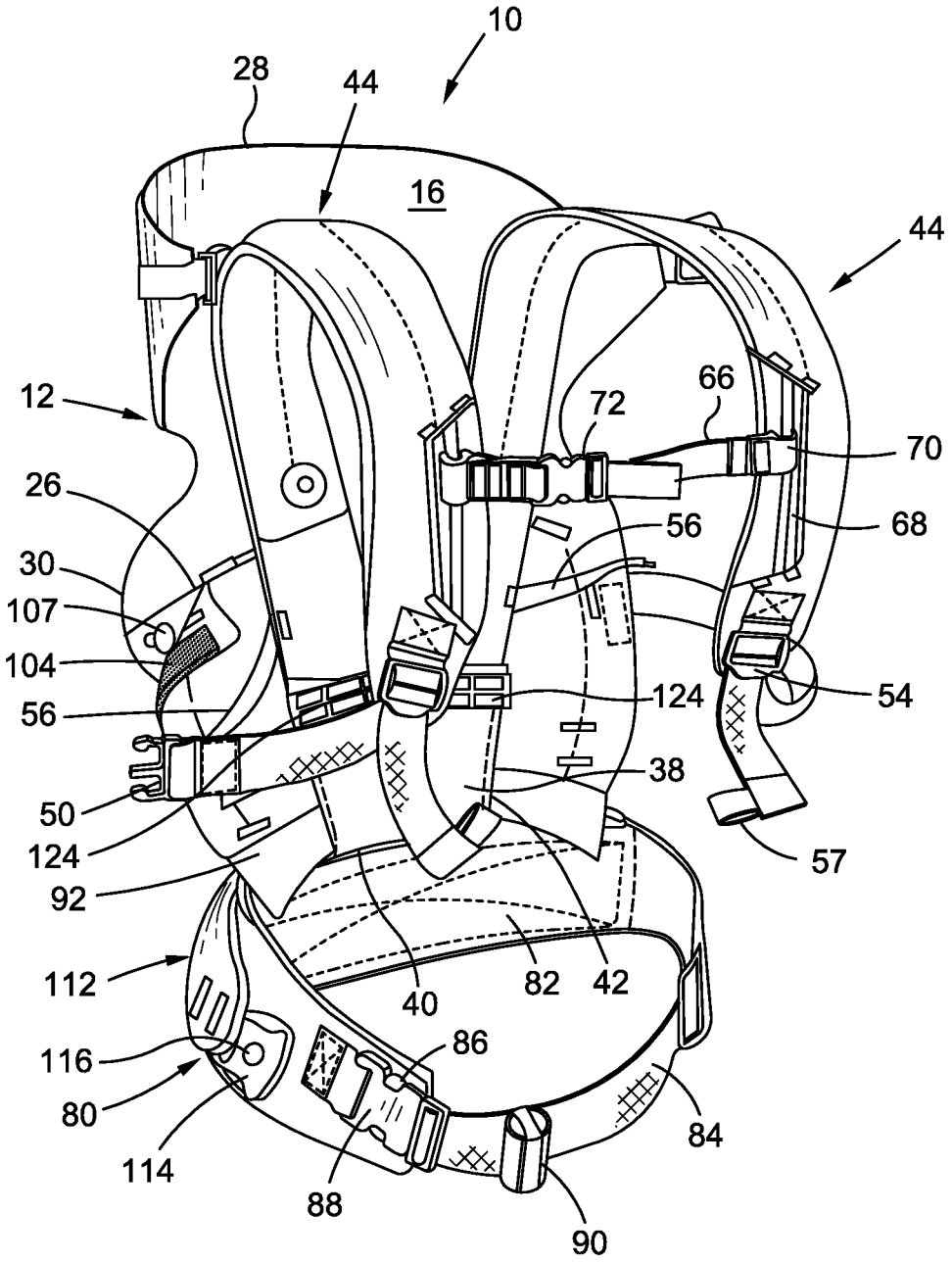
FIG. 3 is a rear perspective view of the infant carrier shown in FIG. 2.

Referring now to the FIGS. 1-3, the carrier 10 comprises a main body panel 12 defining an exteriorly presented outer surface 14, and an opposed, interiorly presented inner surface 16. When viewed from the perspective shown in FIGS. 1 and 2, the main body panel 12 further defines a head portion 18, a bucket or seat portion 20, and a central portion 22 which extends between the head and seat portions 18, 20. Approximately the lower third of the main body panel 12 defines the seat portion 20 thereof, the use of which will be described in more detail below. A first fold seam 24 generally defines the transition between the head and central portions 18, 22, with a second fold seam 26 generally defining the transition between the central and seat portions 20, 22. The head portion 18 defines an arcuately contoured, generally convex top edge segment 28.

As is most easily seen in FIG. 3, the main body panel 12 is constructed in a manner wherein sections of the seat and central portions 20, 22 overlap each other, with such overlapping sections further being selectively separable from each other, though the top edge of the seat portion 20 when viewed from the perspective shown in FIGS. 1-3 is permanently attached to the central portion 22 at the second seam 26. Along these lines, the opposed ends of this top edge segment 28 transition into each of an opposed pair of non-linear side edge segments 30 defined by the central portion 22. As seen in FIG. 1, portions of these side edge segments 30 run along the outer surface of the seat portion 20 in overlapping relation thereto, and terminate at a bucket or seat strap segment 32 of the central portion 22 which projects or protrudes downwardly from the remainder thereof. As seen in FIGS. 1 and 2, the seat strap segment 32 extends in overlapping relation to the seat portion 20. The seat strap segment 32 also defines an outer surface which normally defines a portion of the collective outer surface 14 of the main body panel 12, and an opposed inner surface having a swatch 34 of hook and loop fastener material thereon. This swatch 34 is releasably securable to a corresponding, complementary swatch 36 of hook and loop fastener material which is disposed on a central area of the outer surface of the seat portion 22. As seen in FIG. 2, the releasable engagement of these swatches 34, 36 to each other maintains the seat strap segment in firm, overlapping contact with the seat portion 22. The use of the seat strap segment 32 will be discussed in more detail below.

The carrier 10 further comprises a bib panel 38 which defines an outer surface and an opposed inner surface which, in the carrier 10, faces the inner surface 16 of the main body panel 12. In this regard, the main body and bib panels 12, 38, and in particular the inner surfaces defined thereby, collectively form a pouch-like infant or child carrying area of the carrier 10, the bib panel 38 effectively creating a barrier between at least part of that infant carrying area and the chest or back of the wearer. When viewed from the perspective shown in FIG. 3, the bib panel 38 further defines a top edge segment (not labeled), a bottom edge segment 40, and an opposed pair of side edge segments 42 which extend between the top edge segment and the bottom edge segment 40.

The carrier 10 further comprises an identically configured pair of shoulder straps 44 which are adapted to be extensible over respective ones of the wearer's shoulders. Each of the shoulder straps 44 preferably has a two-piece construction. In greater detail, each of the shoulder straps 44 comprises a primary segment 46 which is of a relatively wide and relatively thick padded construction, preferably fabricated from two opposed layers of a soft yet durable fabric material having a padded layer therebetween, the peripheral edges of the fabric layers being secured to each other through the use of stitching. As is most apparent from FIG. 2, one end portion of the primary segment 46 of each shoulder strap 44 is attached to the top edge segment of the bib panel 38.

In addition to the primary segment 46, each shoulder strap 44 includes a secondary segment 48 which is of a narrower and thinner construction (e.g., webbing) in comparison to the corresponding primary segment 46. Within each shoulder strap 44, one end portion of the secondary segment 48 is attached to that end portion of the corresponding primary segment 46 opposite the end portion attached to the bib panel 38. As best seen in FIGS. 1 and 2, the opposite end portion of each secondary segment 48 is operatively coupled to a fastener 50 (e.g., a male buckle) which is releasably attachable to a complementary, corresponding fastener 52 (e.g., a female buckle) itself attached to and protruding from the outer surface of the central portion 22 in relative close proximity to one of the side edge segments defined thereby. The attachment of the primary and secondary segments 46, 48 of each shoulder strap 44 to each other, and to the bib panel 38, is preferably facilitated through the use of stitching. As further seen in FIG. 1, the secondary segments 48 each have a side support adjuster 54 integrated therein that allows for the adjustability in the length of the corresponding shoulder strap 44 relative to the main body and bib panels 12, 38.

In the carrier 10, though the secondary segment 48 of each shoulder strap 44 is releasably attachable to the main body panel 12 in the aforementioned manner through the use of a corresponding pair of the mating fasteners 50, 52, such secondary segment 48 is permanently tethered to the corresponding primary segment 46. In greater detail, as best seen in FIG. 3, the carrier 10 further comprises a pair of elastic tether straps 56, each of which is permanently attached to, and extends between, a respective one of the secondary segments 48 and a corresponding one of the primary segments 46 of the same shoulder strap 44. As will be recognized, the tether straps 56 function to maintain the secondary segments 48 of the shoulder straps 44 in a loose, resilient state of attachment to corresponding ones of the primary segments 46 even when the secondary segments 48 are disengaged from the main body panel 12 as a result of the detachment of each of the two corresponding pairs of fasteners 50, 52 from each other. By maintaining this state of engagement, the carrier 10 is more easily operatively positioned on and secured to the wearer, in comparison to what would otherwise transpire if the secondary segments 48 were not permanently tethered to the primary segments 46. In this regard, the tether straps 56 effectively maintain each of the shoulder straps 44 in a closed-loop configuration relative to the bib panel 38 even when the secondary segments 48 are detached from the central portion 22 of the main body panel 12.

It is also contemplated that in the carrier 10, the secondary segment 48 of each of the shoulder straps 44 may be outfitted with a storage loop 57. The storage loop 57 is adapted to accommodate a portion of the secondary segment 48 of the same or other remaining shoulder strap 44 for the compact, efficient storage thereof.

In the carrier 10, the primary segment 46 of each shoulder strap 44, in addition to being permanently attached to the top edge segment of the bib panel 38, is also releasably attachable to the main body panel 12, and in particular to the head portion 18 of the main body panel 12. In greater detail, the carrier 10 further comprises an identically configured pair of connector posts 58, each of which is permanently attached to a central portion of a respective one of the primary segments 46. Each post 58 is releasably attachable to a complementary, corresponding fastener 60. These fasteners 60, which are also identically configured to each other, protrude from respective opposed ends of the head portion 18 at approximately corresponding ones of the terminal ends of the top edge segment 28 in the manner best seen in FIG. 1.

Though not shown with particularity, each of the fasteners 60 is a unique spring latch which comprises a housing having a single, unitary lock member operatively engaged thereto. The lock member is interfaced to the housing in a manner wherein an opposed pair of finger press key portions defined by the lock member protrude from respective opposed sides of the housing. The simultaneous pressing of the opposed finger press key portions inwardly toward each other facilitates the concurrent movement of an opposed pair of arcuate engagement portions also defined by the lock member away from each other, thus releasing them from a corresponding post 58 as allows such post 58 to be removed from within a complementary, circularly configured opening defined solely by the housing. Conversely, releasing the press key portions causes the engagement portions to resiliently spring or return to their original position as facilitates their cooperative engagement to the post 58 when such post 58 is advanced through the central opening of the housing. In this regard, the lock member also includes a pair of resilient spring portions, each of which is integrally connected to and extends between the key portions, and includes one of the engagement portions integrally connected thereto.

Referring again to FIG. 1, disposed on the outer surface 14 of the main body panel 12 on the head portion 18 thereof and proximate to the top edge segment 28 is an identically configured, horizontally aligned pair of connectors 62 (e.g., male snaps). In addition, disposed on the outer surface 14 of the main body panel 12 on the central portion 22 thereof is an identically configured, horizontally aligned pair of connectors 64 (e.g., female snaps). Each of the connectors 62 is adapted to be releasably engageable to a respective one of the connectors 64. In the carrier 10, the head portion 18 is adapted to be selectively folded along the first fold seam 24 to transition from its extended state (shown in FIGS. 1-3) to a folded state. The head portion 18 is maintainable in its folded state by the releasable engagement of the connectors 62 to respective ones of the connectors 64. When the head portion 18 is in its folded state, at least a portion of the outer surface 14 of the main body panel 12 as defined by the head portion 18 is directed toward or faces a portion of the outer surface 14 of the main body panel 12 as defined by the central portion 22, with a portion of the inner surface 16 of the main body panel 12 thus being outwardly or exterior presented. As will be recognized by those of ordinary skill in the art, the positioning of the head portion 18 of the main body panel 12 in its extended state provides a greater measure of support to the head of an infant carried within the carrier 10.

The carrier 10 is further provided with a cross strap 66 which extends between and selectively interconnects the shoulder straps 44. In greater detail, the primary segment 46 of each shoulder strap 44 includes an elongate, bead or cord-like segment 68 which protrudes from the exterior surface thereof, and extends partially there along in a lengthwise direction. The opposed ends of the cross strap 66 are each outfitted with a slide coupler 70 which is cooperatively engaged to and slidably positionable along the length of a respective one of the segments 68. As will be recognized by those of ordinary skill in the art, the cooperative engagement of the cross strap 66 to each of the shoulder straps 44 via the engagement of the slide couplers 70 to respective ones of the segments 68 allows for variability or adjustability in the positioning of the cross strap 66 relative to the shoulder straps 44. The cross strap 66 preferably includes a buckle 72 comprising male and female connectors integrated therein. As will be recognized, the detachment of the male and female connectors of the buckle 72 from each other effectively separates the cross strap 66 into two independent segments coupled to respective ones of the primary segments 46 via respective ones of the slide couplers 70. Securing the male and female connectors of the buckle 72 to each other as facilitates the continuous extension of the cross strap 66 between the shoulder straps 44 assists in maintaining the shoulder straps 44, and in particular the primary segments 46 thereof, in a relatively fixed spatial relationship relative to each other. The manner in which the buckle 72 is integrated into the cross strap 66 allows for adjustability in the fixed length of the cross strap 66 as it extends between the primary segments 46 of the shoulder straps 44.

The carrier 10 is further outfitted with a spaced pair of head support webs 74 which are integrated into the head portion 18 in spaced relation to each other, each of the head support webs 74 extending along the outer surface of the head portion 18 in close proximity to the top edge segment 28 and a respective one the opposed ends thereof. Each of the head support webs 74 has a corresponding head support adjuster 76 cooperatively engaged thereto. Both pairs of the head support webs/adjusters 74, 76 may be manipulated individually, or in combination, to facilitate selective increases of decreases in the effective end-to-end width of the head portion 18. Also, though not shown, it is contemplated that the carrier 10 may be used in combination with an optional hood extension. The cooperative engagement of such hood extension to the carrier 10 is preferably achieved through releasable attachment of connectors (e.g., snaps) included on the hood extension to the connectors 62 of the main body panel 12 and/or connectors (e.g., male snaps) 78 disposed on respective ones of the primary segments 46 of the shoulder straps 44.

The carrier 10 further comprises an elongate waist belt 80 which it is extensible about the waist of a wearer. The waist belt 80 preferably comprises a primary belt segment 82 which is of a relatively wide and relatively thick padded construction, preferably fabricated from two opposed layers of the soft yet durable fabric material having a padded layer therebetween, the peripheral edges of the fabric layers being secured to each other through the use of stitching. The waist belt 80 also includes a secondary belt segment 84 which is attached to and protrudes from one end portion of the primary belt segment 82, and is of a narrower and thinner construction (e.g., webbing) in comparison to the primary belt segment 82. Attached to and selectively positionable along the length of the secondary belt segment 76 is a fastener 86 (e.g., a male buckle) which is releasably engageable to a complementary fastener 88 (e.g., a female buckle) attached to that end portion of the primary belt segment 82 opposite that having the secondary belt segment 84 protruding therefrom. As will be recognized, the coupling of the fasteners 78, 80 to each other effectively maintains the waist belt 80 in a closed-loop configuration, the circumference of which can be selectively increased or decreased through the adjustment of the positioning of the fastener 86 on the secondary belt segment 84. The secondary belt segment 84 may optionally be outfitted with a storage loop 90. The storage loop 90 is adapted to accommodate a portion of the secondary belt segment 84 for the compact, efficient storage thereof.

In the carrier 10, both the main body and bib panels 12, 38 are permanently attached to the waist belt 80, with the use of stitching being an exemplary attachment modality. In greater detail, as viewed from the perspective shown in FIGS. 1-3, it is contemplated that a segment of the bottom edge of the seat portion 20 which spans and is of generally equal width to the bottom edge segment of the swatch 36 applied thereto will be operatively coupled to the waist belt 80 at or in relative close proximity to the top edge defined by the primary belt segment 82 thereof. Similarly, the bottom edge segment 40 defined by the bib panel 38 will be operatively coupled to the waist belt 80 at or in relative close proximity to the top edge defined by the primary belt segment 82 thereof. With such attachment, the main body and bib panels 12, 38 collectively define a child carrying area of the carrier. In this regard, as indicated above, the main body and bib panels 12, 38 as attached to the primary belt segment 82 of the waist belt 80, and in particular the inner surfaces defined by the main body and bib panels 12, 38, collectively form a pouch-like infant or child carrying area of the carrier 10, the bib panel 38 effectively creating a barrier between at least part of that infant carrying area and the chest or back of the wearer.

Figure 4:
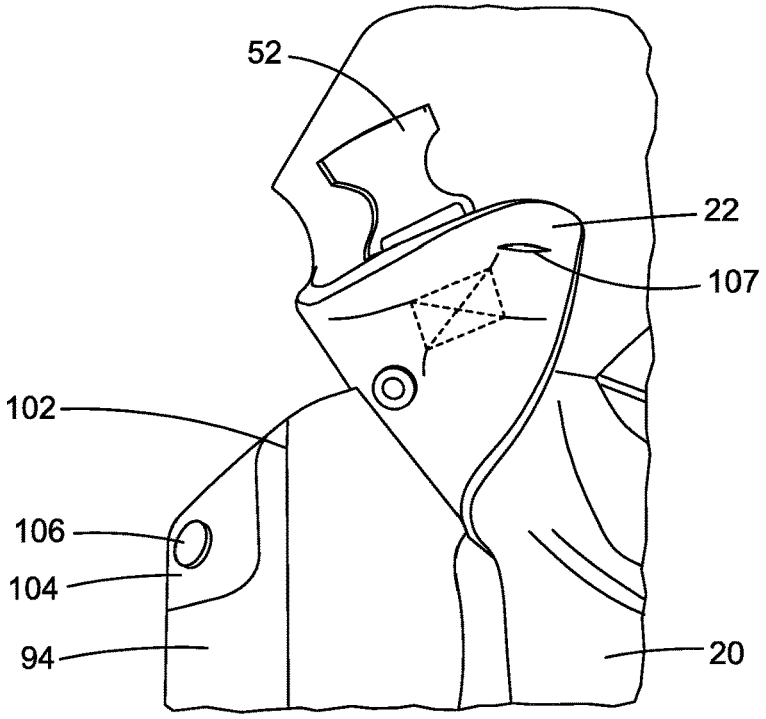
FIG. 4 is an enlargement of a portion of the infant carrier shown in FIGS. 1-3, depicting the particulars of one of the two adjustment arrangements integrated into the central and seat portions of the main body panel to maintain a corresponding section of the seat portion in any one of a fully expanded configuration, a partially expanded configuration, and a retracted configuration.
Figure 5:
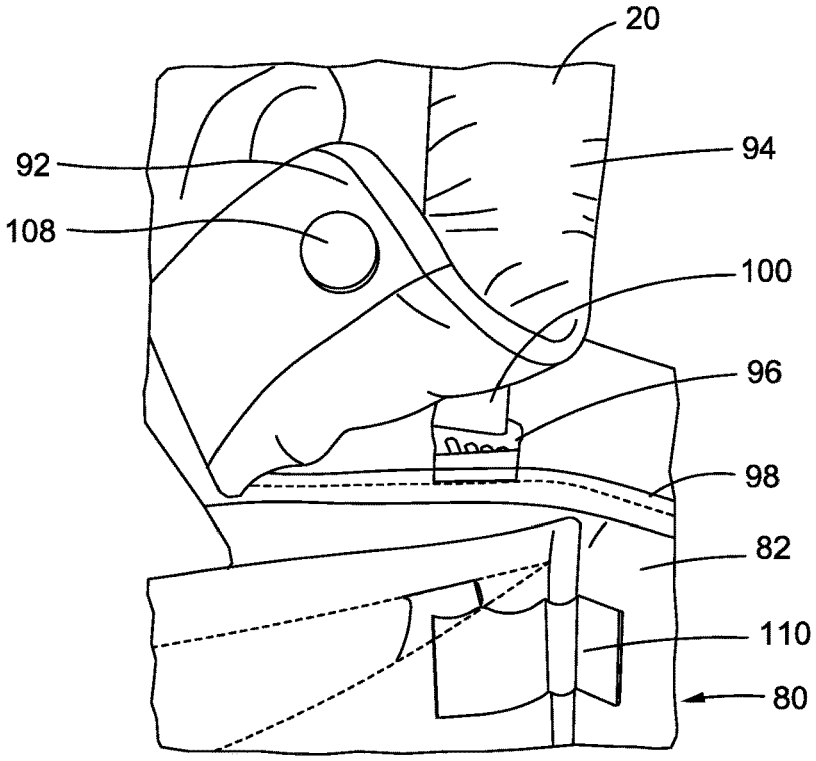
FIG. 5 is an enlargement of a portion of the infant carrier shown in FIGS. 1-3, depicting the particulars of one of the two securing arrangements integrated into the seat portion of the main body panel and the waist belt to maintain a corresponding section of the seat portion in fully expanded configuration.

Referring now to FIGS. 4-5 in conjunction with FIGS. 1-3, while the above-described segment of the bottom edge of the seat portion 20 is permanently secured to the waist belt 80, lower regions 92 defined by respective ones of opposed side sections 94 of the seat portion 20 are slidably secured to the primary belt segment 82 of the waist belt 80. Such slidable engagement is facilitated by respective ones of an identically configured pair of slider buckles 96 which are each operatively coupled to a complementary slider tube 98 attached to and extending along a portion of the top edge segment defined by the primary belt segment 82 of the waist belt 80. The slider buckles 96 are each coupled to the outer surface of the lower region 92 of a respective one of the side sections 94 through the use of a corresponding slider loop 100 formed from a looped segment of suitable webbing.

Though not shown with particularity, each of the slider buckles 96 comprises a housing having a cam lever pivotally connected thereto. The housing defines an elongate opening which communicates with an elongate slot. The opening/slot combination are adapted to accept the slidable receipt of the complementary slider tube 98. With the slider tube 98 being received into the opening/slot, the rotation of the cam lever results in a cam portion thereof protruding into the opening and firmly engaging the slider tube 98, thus effectively locking the slider buckle 96 to the slider tube 98 in a prescribed position along the length thereof. Conversely, rotating the cam lever in the opposite direction releases the cam portion from its engagement to the slider tube 98, thus allowing for the slidable movement of the slider buckle 96 along the slider tube 98 to an alternative location along the length thereof, whereat the cam portion of the cam lever can once again be frictionally engaged to the slider tube 98.

As seen in FIG. 3, when the lower regions 92 of the side sections 94 of the seat portion 20 are slidably interfaced to the slider tube 98 through the use of the slider buckles 96 in combination with the slider tube 98, portions of the lower regions below the attachment points for the slider loops 100 overlap the inner surface of the primary belt segment 82 of the waist belt 80. These overlapping portions of the lower regions 92 define a pair of seat skirts which create an effective barrier between the slider buckles 96 and the wearer's body.

As best seen in FIG. 4, upper regions 102 defined by respective ones of the opposed side sections 94 of the seat portion 20, and the central portion 22, are also each outfitted with adjustment arrangements which allow the side sections 94 to either be releasably secured to the central portion 22 or, when released therefrom, folded into overlapping relation to a central section of the seat portion 20 and maintained in releasable engagement thereto. In greater detail, each adjustment arrangement of the pair included in the carrier 10 comprises a swatch 104 of hook and loop fastener material which is applied to the outer surface of the upper region 102 of a respective one of the side sections 94 of the seat portion 20. Protruding from within the swatch 104 is a button 106 of the corresponding adjustment arrangement. Each adjustment arrangement further includes a button hole 107 which extends through the central portion 22 proximate a respective one of the opposed side edge segments 30 thereof.

The receipt of the button 106 of each adjustment arrangement into its corresponding button hole 107 maintains at least the upper region 102 of the corresponding side section 94 in an expanded configuration within the carrier 10, as will be described in greater detail below. Conversely, the removal of the button 106 of each adjustment arrangement from within its corresponding button hole 107 allows at least the upper region 102 of the corresponding side section 94 to be folded into overlapping relation to the central section of the seat portion 20 and maintained in releasable attachment thereto via the engagement of the swatch 104 to the swatch 36, thus placing such side section 94 into a retracted configuration within the carrier 10, as will also be described in greater detail below. As will be recognized and as will be described in greater detail below as well, the swatch 34 of the seat strap segment 32 must be disengaged from the swatch 36 and the seat strap segment 32 lifted therefrom as a precursor to the swatches 104 of the adjustment arrangements each being concurrently releasably engageable to the swatch 36.

In addition, the lower regions 92 of the opposed side sections 94 of the seat portion 20, and the primary belt segment 82 of the waist belt 80, are each outfitted with securing arrangements which allow the side sections 94 to optionally be maintained in releasable engagement to the waist belt 80. In greater detail, each securing arrangement of the pair included in the carrier 10 comprises a circularly configured swatch 108 of hook and loop fastener material which is applied to the outer surface of the lower region 92 of a respective one of the side sections 94 of the seat portion 20. Each securing arrangement further includes a swatch 110 of hook and loop fastener material which is applied to the inner surface of the primary belt segment 82 of the waist belt 820 proximate the top edge thereof. The releasable engagement of each swatch 108 to its corresponding swatch 110 maintains at least the lower region 92 of the corresponding side section 94 in an expanded configuration within the carrier 10, as will be described in greater detail below. Conversely, the disengagement of each swatch 108 from its corresponding swatch 110 allows at least the lower region 92 of the corresponding side section 94 to be slidably moved, through the use of the associated slider buckle 96 and slider tube 98 combination, toward a retracted configuration within the carrier 10, as will also be described in greater detail below.

Figure 6:
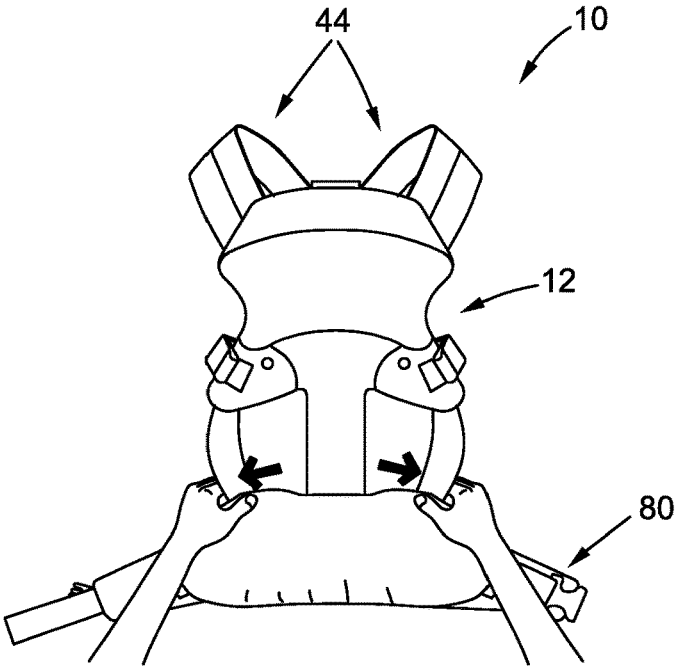
FIG. 6 is a front elevational view of the infant carrier similar to FIG. 2, depicting the seat portion of the carrier in a fully expanded configuration, with the seat sling of the carrier being depicted in a stowed state in engagement with the waist belt of the carrier.

Through the use of the slider buckles 96/slider tube 98 alone or in combination with the adjustment and securing arrangements, the side sections 94 of the seat portion 20 can optionally be manipulated into any one of three (3) different configurations or states. The first of these is a fully expanded configuration as shown in FIGS. 2 and 6. In this fully expanded configuration, both the upper and lower regions 102, 92 of each of the side sections 94 of the seat portion 20 are fully extended from the central section thereof. The lower regions 92 of the side sections 94 are maintained in this fully extended state via both the slider buckles 96 which are frictionally engaged to and maintained in locations on the slider tube 98 which correspond to the expanded positions of the lower regions 92, and the releasable attachment of the lower regions 92 to the waist belt 80 via the securing arrangements, i.e., the releasable engagement of each swatch 108 to a respective one of the swatches 110. The upper regions 102 of the side sections 94 are maintained in this fully extended state via the releasable attachment thereof to the central portion 22 via the adjustment arrangements, i.e., the receipt of each button 106 into a respective one of the button holes 107.

Figure 7:
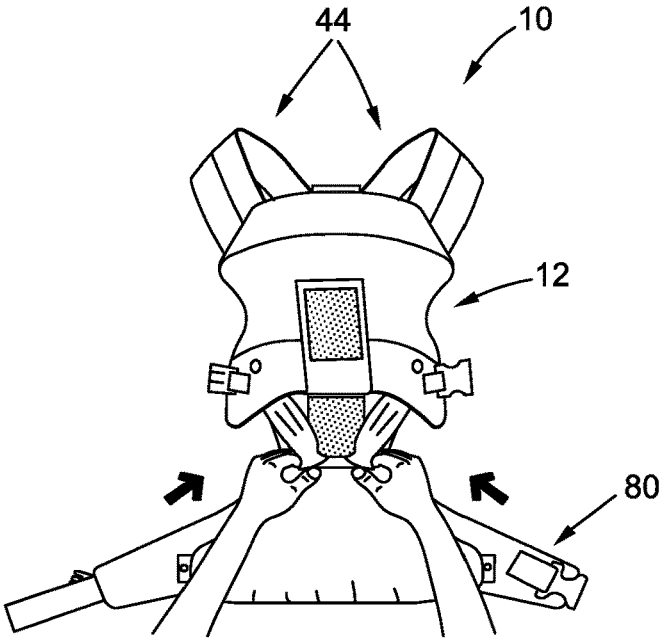
FIG. 7 is a front elevational view of the infant carrier similar to FIG. 2, but depicting the seat portion of the carrier in a partially expanded configuration, with the seat sling of the carrier being depicted in a stowed state in engagement with the waist belt of the carrier.
Figure 8C:
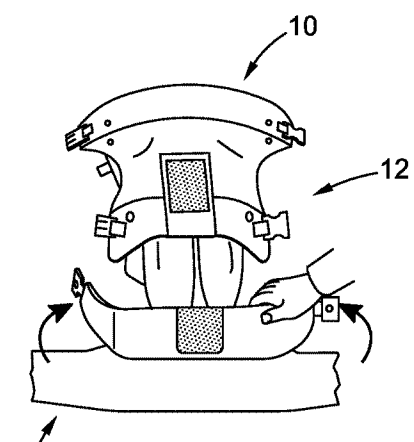
FIGS. 8A-8E are a series of front elevational views of the infant carrier similar to FIG. 7, but depicting the transition of the seat portion of the carrier from a partially expanded configuration to a fully retracted configuration, followed by the transition of the seat sling from its stowed state toward its deployed state.
Figure 8B:
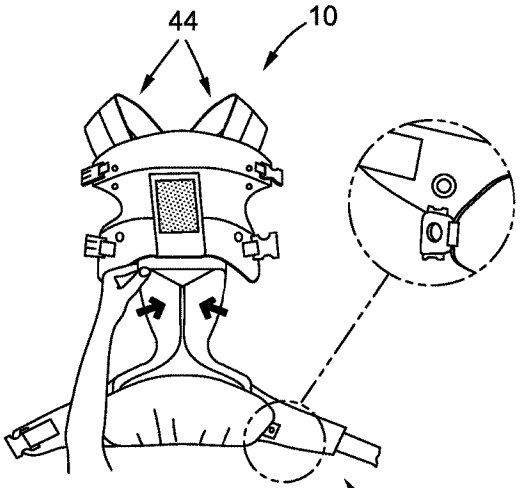
Figure 8A:
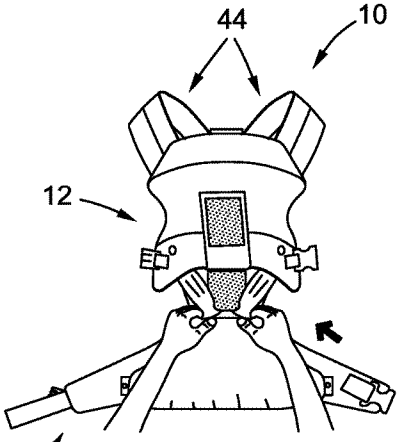

The second of these configurations is a partially expanded configuration as shown in FIGS. 7 and 8A. In this partially expanded configuration, the upper region 102 of each of the side sections 94 of the seat portion 20 is fully extended from the central section thereof, while the lower regions 92 of the side sections 94 are each retracted or narrowed inwardly toward the central section of the seat portion 20. The lower regions 92 are maintained in this retracted state via the slider buckles 96 which are frictionally engaged to and maintained in locations on the slider tube 98 which correspond to the retracted positions of the lower regions 92. The upper regions 102 of the side sections 94 are maintained in this fully extended state via the releasable attachment thereof to the central portion 22 via the adjustment arrangements, i.e., the receipt of each button 106 into a respective one of the button holes 107.

The third of these configurations is a fully retracted configuration as shown in FIG. 8B. In this fully retracted configuration, the upper region 102 of each of the side sections 94 of the seat portion 20 (after the buttons 106 have been removed from within the corresponding button holes 107) is folded into overlapping relation to the central section of the seat portion 20 and releasably secured thereto via the engagement of the swatches 104 to the swatch 36. As indicated above, the swatch 34 of the seat strap segment 32 must be disengaged from the swatch 36 and the seat strap segment 32 lifted therefrom as a precursor to the swatches 104 each being concurrently releasably engageable to the swatch 36. In the fully retracted configuration, the lower regions 92 of the side sections 94 are each retracted or narrowed inwardly toward the central section of the seat portion 20, and are maintained in this state via the slider buckles 96 which are frictionally engaged to and maintained in locations on the slider tube 98 which correspond to the retracted positions of the lower regions 92.

The carrier 10 further comprises a seat sling 112 which is coupled to the waist belt 80, and selectively movable between stowed and deployed configurations or states relative thereto. In greater detail, when viewed from the perspective shown in FIGS. 1-3, a portion of the top edge of the seat sling 112 is permanently attached to the outer surface of the primary belt segment 82 proximate the top edge thereof through the use of, for example, stitching, such that the seat sling 112 defines a flap-like structure capable of upward and downward foldable movement relative to the waist belt 80. As seen in FIG. 2, in the stowed state, the seat sling 112 is maintained in overlapping relation to an outer surface portion of the primary belt segment 82 of the waist belt 80 through the use of an identically configured pair of fasteners 114 which protrude from respective ones of the opposed ends of the seat sling 112, and are secured to the inner surface thereof via respective ones of a pair of fastener loops 115. The fasteners 114 are preferably identically configured to the fasteners 60, and thus also each comprise the unique spring latch described with particularity above in relation to the fasteners 60. Along these lines, the fasteners 114 are selectively, releasably engageable to either respective ones of a first pair of connector posts 116 disposed on the outer surface of the primary belt segments 82 proximate respective ones of the opposed ends of the seat sling 112, or to respective ones of a second pair of connector posts 118 disposed on the outer surface of the central portion 22 of the main body panel 12 is generally horizontally aligned, spaced relation to each other. The connector posts 116, 118 are identically configured to each other and to the aforementioned posts 58, with the fasteners 114 being releasably engaged to either the posts 116 or the posts 118 in the same manner described above regarding the releasable engagement of the fasteners 60 to the posts 58.

As will be discussed in more detail below, the seat sling 112 is maintained in the stowed configuration with the fasteners 114 being coupled to respective ones of the posts 116 when the side sections 94 are in either the fully expanded or partially expanded configurations. In the deployed state, the fasteners 114 are detached from the posts 116 of the waist belt 80, and alternatively used to releasably attach the seat sling 112 to the posts 118 on the central portion 22 of the main body panel 12. The seat sling 112 is manipulated into the deployed configuration only when the side sections 94 are in the fully retracted configuration. The seat sling 112 defines a central seat gusset 120. The inner surface of the seat sling 112 at the seat gusset 120 (such inner surface facing the primary belt segment 82 when the seat sling 112 is in the stowed state), includes a swatch 122 of hook and loop fastener material thereon, the use of which will also be described in more detail below.

The infant carrier 10 further comprises a pair of elongate leg loops 124 which are attached to respective ones of the opposed side edge segments 42 of the bib panel 38 in spaced relation to the top edge of the primary belt segment 82 of the waist belt 80. The leg loops 124 are selectively, releasably attachable to respective ones of the buttons 106 of the adjustment arrangements integrated into the upper regions 102 of respective ones of the side sections 94 of the seat portion 20. The leg loops 124, when attached to the corresponding buttons 106, create prescribed attachment points between the main body and bib panels 12, 38, and facilitate the formation of a spaced pair of comparatively smaller leg openings between the leg loops 124 and the waist belt 80. Typically, the leg loops 124 will be deployed to facilitate the formation of these smaller leg openings when the side sections 94 are in the partially expanded configuration to provide a safeguard for a smaller infant being carried within the carrier 10, assisting in preventing the infant from being able to slip out from between the main body and bib panel 12, 38.

In the carrier 10, the main body panel 12 is preferably fabricated from two opposed layers of a soft yet durable fabric material, the peripheral edges of which are secured to each other through the use of stitching. Additionally, a padded layer is interposed between prescribed areas of these fabric layers. Additionally, those of ordinary skill in the art that attachment modalities other than for snaps, buckles, buttons and button holes may be substituted for the various fasteners/attachment modalities described above without departing from the spirit and scope of the present disclosure.

Based on the structure of the infant carrier 10 as described above, it is suitable for use in a variety of different configurations. In greater detail, for infants weighing about 8-15 lbs., the infant carrier 10 is suitable for use in a front carry configuration with the infant facing the wearer's chest, such configuration being shown in FIG. 7. In this instance, it is contemplated that the side sections 94 will be moved to the partially expanded configuration described above, with the seat sling 112 being maintained in its stowed state. The leg loops 124 may also optionally be deployed in conjunction with this particular configuration. Along these lines, if the leg loops 124 are indeed deployed, they will be cooperatively engaged to the buttons 106 concurrently with the central portion 22 being cooperatively engaged to the buttons 106 through the use of the button holes 107.

For infants weighing about 15-40 lbs., the infant carrier 10 is suitable for use in a front carry configuration with the infant facing the wearer's chest, such configuration being shown in FIG. 6. In this instance, it is contemplated that the side sections 94 will be moved to the fully expanded configuration described above, with the seat sling 112 being maintained in its stowed state. The leg loops 124 are typically not deployed in conjunction with this particular configuration.

Figure 8E:
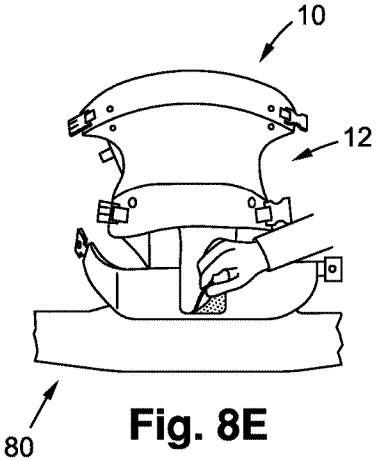
Figure 8D:
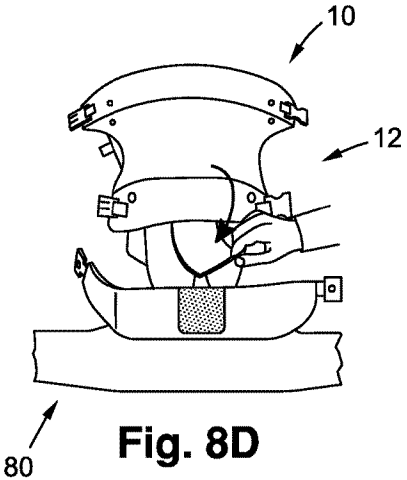

For infants strong enough to maintain their heads in an upright position, the infant carrier 10 is suitable for use in a front carry configuration with the infant facing away from the wearer's chest. The manipulation of the carrier 10 into this configuration is exemplified by the sequence of steps shown in FIGS. 8A-8E, the partial manipulation into such configuration also being shown in FIG. 1. In this instance, it is contemplated that the side sections 94 will be moved to the fully retracted configuration described above, with the seat sling 112 being moved from its stowed state to its deployed state in the manner also described above. The leg loops 124 are not deployed in conjunction with this particular configuration. However, the head portion 18 of the main body panel 12 will typically be moved from its extended state to its folded state in the aforementioned manner through the use of the connectors 62, 64. As also explained above, and as is apparent from FIGS. 2 and 8A-8E, the swatch 34 of the seat strap segment 32 is disengaged from the swatch 36 and the seat strap segment 32 lifted therefrom (i.e., folded upwardly) as a precursor to the swatches 104 of the adjustment arrangements each being concurrently releasably engageable to the swatch 36, and the seat sling 112 being moved to its deployed state wherein the fasteners 114 are coupled to respective ones of the posts 118. Once the fasteners 114 of the seat sling 112 are operatively coupled to the posts 118, the inner surface of the seat sling 112, and hence the swatch 122 thereon, will be outwardly or exteriorly presented, thus allowing the seat strap segment 32 to be unfolded downwardly (FIG. 8D) such that the swatch 34 thereof is cooperatively engageable to the swatch 122 (FIG. 8E). A reverse sequence occurs when the seat sling 112 is returned to its stowed state wherein the fasteners 114 are coupled to respective ones of the posts 116.

Finally, for infants strong enough to sit upright, the infant carrier 10 is suitable for use in a rear carry configuration with the infant facing the wearer's back. In this instance, it is contemplated that the side sections 94 will be moved to the fully expanded configuration described above, with the seat sling 112 being maintained in its stowed state. The leg loops 124 are typically not deployed in conjunction with this particular configuration.

In either of the front or rear carry configurations, it is contemplated that seat portion 20 of the main body panel 12 will at least partially overhang or be draped over the waist belt 80, with the weight of the infant being transferred not only into the waist belt 80 for distribution into the wearer's hips, but also into the shoulder straps 44 for distribution into each of the wearer's shoulders. As previously explained, if warranted by the small size of the infant, the leg loops 124 may also be used for purposes of defining the aforementioned smaller leg openings. Still further, the head portion 18 of the main body panel 12 may be selectively manipulated between its extended and folded states in the aforementioned manner as may be need to properly support the head of the infant within the carrier 10. Because they are outfitted with the length/width adjusting modalities described above, the effective lengths of both the shoulder straps 44 and the waist belt 80, as well as the width of the head portion 18, may be selectively increased or decreased as needed to achieve a proper fit of the carrier 10 to the wearer based not only on the wearer's physical attributes, but those of the infant to be carried as well. In this regard, as will be recognized, the adaptability of the carrier 10 to the infant's physical features is further enhanced by the width adjustability of the seat portion 20, as well as the optional deployment of the leg loops 100 and the folding/unfolding of the head portion 18 of the main body panel 12.

Those of ordinary skill in the art will also recognize that the carrier 10 may be outfitted with a shoulder strap arrangement differing from that described above without necessarily departing from the spirit and scope of the present invention. By way of example, the carrier 10 may include a shoulder strap arrangement wherein, by virtue of the elimination of the bib panel 38, those end portions of the primary segments 46 attached to the bib panel 38 are instead attached directly to the main body panel 12 proximate prescribed regions along the top edge segment 28 thereof. In another variant wherein the bib panel 38 is also potentially eliminated, those end portions of the primary segments 46 attached to the bib panel 38 are instead attached directly to the waist belt 80 proximate to the top edge of the primary belt segment 82 thereof.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable infant carrier wearable by a user for carrying an infant, the infant carrier comprising:

a main body panel defining at least a central portion and a seat portion having opposed side sections;

a bib panel disposed in at least partially overlapping relation to the main body panel;

a waist belt extensible about the waist of a wearer, portions of the main body and bib panels being attached to the waist belt so as to collectively define an infant carrying area of the carrier;

a pair of shoulder straps extensible over the shoulders of the wearer and each operatively coupled to the main body and bib panels; and a seat sling operatively connected to the waist belt and being selectively positionable in one of a stowed state in overlapping relation to the waist belt and a deployed state in further cooperative engagement to the central portion of the main body panel;

the side sections of the seat portion being selectively fully extensible, partially extensible and fully retractable relative to the central portion and the waist belt.

2. The adjustable infant carrier of claim 1, further comprising:

a pair of leg loops attached to and protruding from the bib panel in opposed relation to each other;

each of the leg loops being selectively, releasably attachable to the main body panel to facilitate the formation of a spaced pair of leg openings between the leg loops and the waist belt.

3. The adjustable infant carrier of claim 1, wherein the main body panel further defines a head portion which is foldable relative to the remainder thereof from an extended state to a folded state, the head portion at least partially overlapping the remainder of the main body panel when in the folded state.

4. The adjustable infant carrier of claim 1, wherein each of the shoulder straps comprises opposed first and second ends portions which are each coupled to respective, prescribed regions of the main body and bib panels.

5. The adjustable infant carrier of claim 4, wherein the first and second end portions of each of the shoulder straps are disposed at a common side of axis which extends between and separates the side sections of the seat portion of the main body panel from each other.

6. The adjustable infant carrier of claim 1, wherein the opposed side sections of the seat portion are cooperatively engaged to the waist belt by respective ones of a pair of slider buckles operative to facilitate the movement of the side sections relative to the central portion and the waist belt.

7. The adjustable infant carrier of claim 6, wherein each of the opposed side sections of the seat portion defines a lower region which at least partially overlaps the waist belt in a manner facilitating the creation of a barrier between a respective one of the slider buckles and the user when wearing the infant carrier.

8. The adjustable infant carrier of claim 7, wherein the lower region of each of the opposed side sections of the seat portion is outfitted with an adjustment arrangement which is adapted to allow the corresponding one of the side sections to optionally be maintained in releasable engagement to the waist belt.

9. The adjustable infant carrier of claim 1, wherein:

each of the opposed side sections of the seat portion defines an upper region;

the seat portion further defines a central section; and the upper regions of the side sections and the central portion of the main body panel are outfitted with adjustment arrangements which are adapted to allow the side sections to either be releasably secured to the central portion or, when released therefrom, to be folded into overlapping relation to the central section and maintained in releasable engagement thereto.

10. The adjustable infant carrier of claim 1, wherein the central portion of the main body panel includes a seat strap segment which is simultaneously extensible over the seat sling in the deployed state, and portions of the side sections as fully retracted relative to the central portion.

11. An adjustable infant carrier wearable by a user for carrying an infant, the infant carrier comprising:

a main body panel defining at least a central portion and a seat portion having opposed side sections;

a waist belt extensible about the waist of a wearer, portions of the main body panel being attached to the waist belt so as to collectively define an infant carrying area of the carrier;

a pair of shoulder straps extensible over the shoulders of the wearer and each operatively coupled to the main body panel; and a seat sling operatively connected to the waist belt and being selectively positionable in one of a stowed state in overlapping relation to the waist belt and a deployed state in further cooperative engagement to the central portion of the main body panel;

the side sections of the seat portion being selectively fully extensible, partially extensible and fully retractable relative to the central portion and the waist belt.

12. The adjustable infant carrier of claim 11, wherein the opposed side sections of the seat portion are cooperatively engaged to the waist belt by respective ones of a pair of slider buckles operative to facilitate the movement of the side sections relative to the central portion and the waist belt.

13. The adjustable infant carrier of claim 12, wherein each of the opposed side sections of the seat portion defines a lower region which at least partially overlaps the waist belt in a manner facilitating the creation of a barrier between a respective one of the slider buckles and the user when wearing the infant carrier.

14. The adjustable infant carrier of claim 13, wherein the lower region of each of the opposed side sections of the seat portion is outfitted with an adjustment arrangement which is adapted to allow the corresponding one of the side sections to optionally be maintained in releasable engagement to the waist belt.

15. The adjustable infant carrier of claim 11, wherein:

each of the opposed side sections of the seat portion defines an upper region;

the seat portion further defines a central section; and the upper regions of the side sections and the central portion of the main body panel are outfitted with adjustment arrangements which are adapted to allow the side sections to either be releasably secured to the central portion or, when released therefrom, to be folded into overlapping relation to the central section and maintained in releasable engagement thereto.

16. The adjustable infant carrier of claim 11, wherein the central portion of the main body panel includes a seat strap segment which is simultaneously extensible over the seat sling in the deployed state, and portions of the side sections as fully retracted relative to the central portion.

17. An adjustable infant carrier wearable by a user for carrying an infant, the infant carrier comprising:

a main body panel defining:

a central portion having a seat strap segment; and a seat portion having opposed side sections and a central section;

a waist belt extensible about the waist of a wearer, portions of the main body panel being attached to the waist belt so as to collectively define an infant carrying area of the carrier;

a pair of shoulder straps extensible over the shoulders of the wearer and each operatively coupled to the main body panel; and a seat sling operatively connected to the waist belt and being selectively positionable in one of a stowed state in overlapping relation to the waist belt and a deployed state in further cooperative engagement to the central portion of the main body panel;

the side sections of the seat portion each defining an upper region which is releasably securable to the either the central portion or the central section, the side sections further being selectively fully extensible, partially extensible and fully retractable relative to the central portion and the waist belt, with the seat strap segment being simultaneously extensible over the seat sling in the deployed state, and portions of the side sections as fully retracted relative to the central portion.

18. The adjustable infant carrier of claim 17, wherein the opposed side sections of the seat portion are cooperatively engaged to the waist belt by respective ones of a pair of slider buckles operative to facilitate the movement of the side sections relative to the central portion and the waist belt.

19. The adjustable infant carrier of claim 18, wherein each of the opposed side sections of the seat portion further defines a lower region which at least partially overlaps the waist belt in a manner facilitating the creation of a barrier between a respective one of the slider buckles and the user when wearing the infant carrier, the lower region of each of the opposed side sections further being outfitted with an adjustment arrangement which is adapted to allow the corresponding one of the side sections to optionally be maintained in releasable engagement to the waist belt.

20. The adjustable infant carrier of claim 17, wherein the upper regions of the side sections and the central portion of the main body panel are outfitted with adjustment arrangements which are adapted to allow the side sections to either be releasably secured to the central portion or, when released therefrom, to be folded into overlapping relation to the central section and maintained in releasable engagement thereto.

* * * * *